United States Patent [19]

Haug

[11] Patent Number: 4,888,891

[45] **Date of Patent: * Dec. 26, 1989**

[54] LEVELLING ATTACHMENT

[75] Inventor: Walter Haug, Winterhalde, Fed. Rep. of Germany

[73] Assignee: Kassbohrer of North America, Inc., Me.

[ * ] Notice: The portion of the term of this patent subsequent to Apr. 19, 2005 has been disclaimed.

[21] Appl. No.: 182,973

[22] Filed: Apr. 18, 1988

Related U.S. Application Data

[62] Division of Ser. No. 893,890, Aug. 6, 1986, Pat. No. 4,738,037.

[30] Foreign Application Priority Data

Aug. 7, 1985 [DE] Fed. Rep. of Germany ... 8522791[U]

[51] Int. Cl.[4] ..... E01H 4/00

[52] U.S. Cl. ..... 37/222; 172/200

[58] Field of Search ..... 37/219–225, 37/232, 233; 172/197, 199, 200, 612, 684.5

[56] References Cited

U.S. PATENT DOCUMENTS

| | | | |
|---|---|---|---|
| 3,685,404 | 8/1972 | Rich | 37/221 |
| 3,795,069 | 3/1974 | Cheney | 37/219 |
| 4,014,116 | 3/1977 | Baechler | 37/221 |
| 4,083,131 | 4/1978 | Auer | 172/684.5 |
| 4,341,027 | 7/1982 | Rohner | 37/219 |
| 4,523,398 | 6/1985 | Scheibel et al. | 37/222 |
| 4,738,037 | 4/1988 | Haug | 37/222 |

FOREIGN PATENT DOCUMENTS

| | | | |
|---|---|---|---|
| 2416634 | 10/1979 | France | 172/200 |

*Primary Examiner*—Eugene H. Eickholt

*Attorney, Agent, or Firm*—Samuels, Gauthier, Stevens & Kehoe

[57] ABSTRACT

The invention relates to a track maintenance vehicle having a levelling attachment secured to a transverse carrier member at its rear. The levelling attachment faces downwards and is at least partially flexible. For achieving satisfactory levelling of relatively loose snow as well as of encrusted or compacted snow, the levelling attachment comprises a leading portion of triangular cross-sectional shape secured to the transverse carrier member along a first triangle side. The second triangle side of this portion is formed as a rigid compaction surface extending downwards and rearwards from the transverse carrier member. Connected to a rear portion of the compaction surface is a plate-shaped flexible portion extending substantially parallel to the second triangle side in the relaxed state, and in a substantially horizontal direction when under load.

9 Claims, 3 Drawing Sheets

LEVELLING ATTACHMENT

Figure 1:
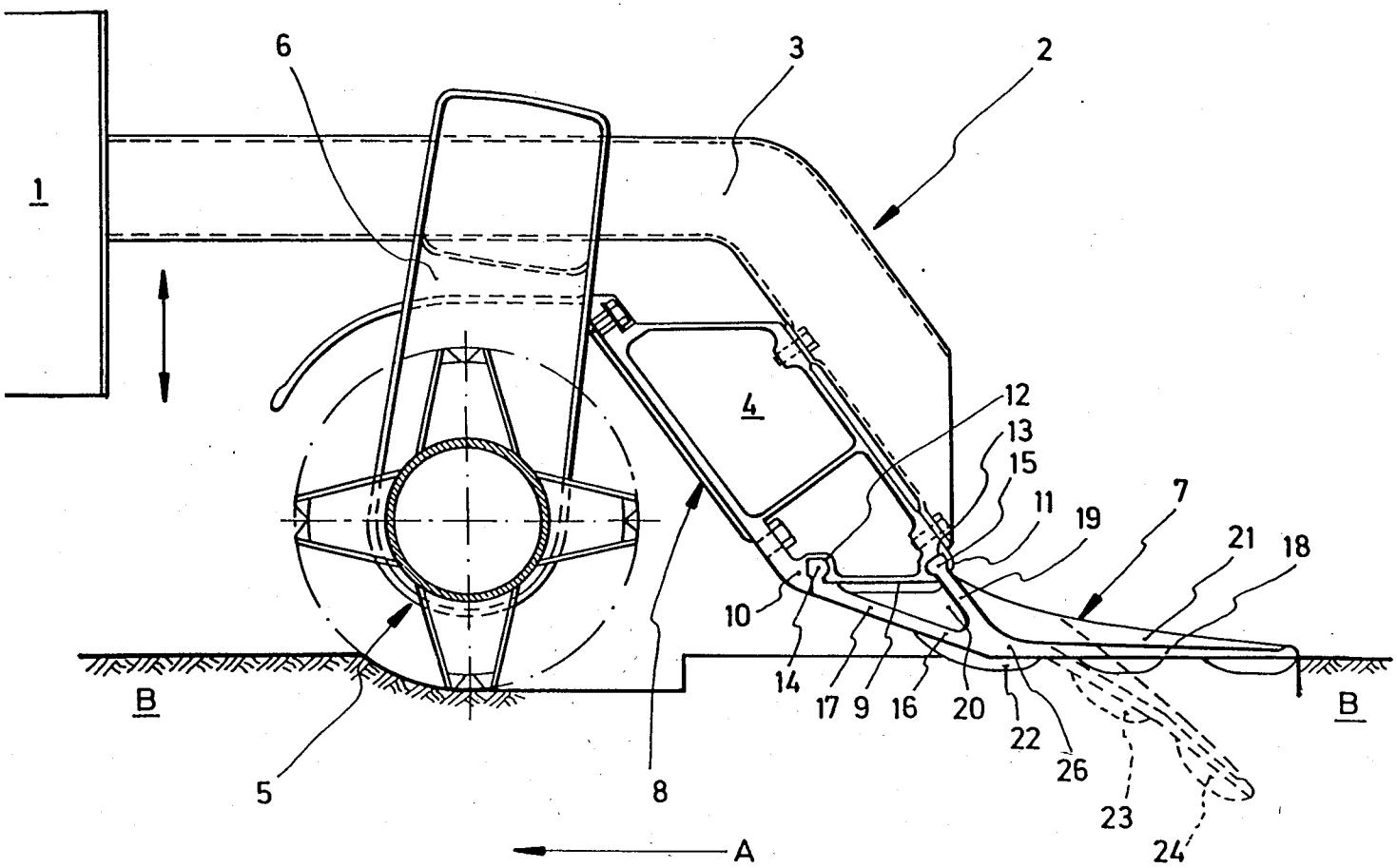

This application is a division of U.S. Ser. No. 893,890 filed on Aug. 6, 1986 and now U.S. Pat. No. 4,738,037.

DESCRIPTION

The present invention relates to a track maintenance vehicle provided with an at least partially flexible levelling attachment secured to a transverse carrier member at the rear so as to face the ground surface.

Track maintenance vehicles of this type equipped with a snow tiller implement are widely known from practical use. The levelling attachment of these vehicles simply consists of a pliable apron secured to a transverse carrier member at the rear of the vehicle or of the snow tiller, respectively. Track maintenance vehicles equipped with an apron of this type are unsatisfactory in that proper levelling of the snow churned up by the track chains of the vehicle or by the tiller is scarcely achievable. This shortcoming is particularly conspicuous in the case of relatively hard snow to be tilled. In this case, the apron offers scarcely any resistance to the snow, with the result that large chunks of relatively hard snow remain on the track and project from its surface.

It is therefore an object of the present invention to improve the operability of a track maintenance vehicle of the type defined above, particularly with a view to achieve proper levelling both of relatively soft snow and of relatively hard, compacted snow by means of a levelling attachment mounted on the rear of the track maintenance vehicle.

To attain this object, the invention provides that the levelling attachment comprises a forward portion of triangular cross-sectional shape secured to the transverse carrier member along a first side of the triangle, a second side of the triangle being formed as a rigid compaction surface extending downwards and rearwards from the transverse carrier member and connected at its rear end to a plate-shaped flexible portion extending substantially parallel to the second side of the triangle in its relaxed state, and in a substantially horiziontal direction when under load, a third side of the triangle being formed as a support wall extending from the rear end of the second side of the triangle to the transverse carrier member.

This solution is effective to considerably broaden the operability range of the track maintenance vehicle. When operating to loosen or to till hard snow, the triangle-profiled rigid forward portion of the levelling attachment is lowered onto the snow surface. This portion offers considerable resistance to to loosened snow which usually still contains larger snow lumps, and its obliquely rising forward surface is effective to slightly compact the loosened snow, thereby depressing the still existing hard snow lumps into the snow surface. In this manner a highly compacted skiing run can be loosened and sufficiently levelled in a single operation. During operation in hard snow, the forwards facing second triangle side of the rigid forward portion absorbs the tension forces, while the rearwards facing third triangle side absorbs the compression forces. In the case of softer snow, the relatively rigid forward portion may be raised above the snow surface, while the plate-shaped flexible rear portion remains in contact with the snow surface for levelling the tilled snow. In this case the obliquely rising forward triangle side assumes a second function in ensuring that the snow thrown up by the snow tiller is uniformly distributed over the width of the implement. The flexible rear portion is capable to smoothly adapt itself to uneven ground contours.

In a preferred embodiment a rigid horizontal web is provided between the rigid portion and the flexible portion of the levelling attachment. This web is advantageously effective to prevent the plate-shaped flexible portion from being bent upwards by the snow, instead of which it slides horizontally over the levelled snow surface to thereby complete the levelling operation.

According to another advantageous aspect, a plurality of vertical reinforcing ribs is secured to the side of the flexible portion facing away from the ground surface to extend parallel to one another in the direction of travel. These ribs enable the desired flexibility of the plate-shaped portion of the levelling attachment to be properly determined in a simple manner. To this effect, the reinforcing ribs may be connected to the third triangle side of the rigid forward portion.

In a particularly advantageous embodiment, the vertical height of the reinforcing ribs decreases towards the rear end of the flexible portion. As a result the flexibility of the plate-shaped portion increases steadily towards the rear end.

The side of the levelling attachment facing towards the track surface is preferably provided with at least one transverse row of elongate bead-shaped ribs extending in the direction of travel. These ribs are effective to depress snow lumps into the track surface to thereby improve the surface quality of the conditioned track.

In a particularly advantageous embodiment, a first transverse row of ribs is disposed on the underside of the web portion with the ribs thereof extending to locations on the second triangle side of the rigid forward portion. These ribs are then capable of crushing larger lumps of hardened snow during the levelling operation.

A second transverse row of ribs advantageously provided on the flexible portion of the levelling attachment on the side thereof facing towards the track. In addition to the above mentioned advantages there ribs are effective to increase the weight of the plate-shaped flexible portion of the levelling attachment to thereby ensure that this portion adapts itself to the contours of the track surface in an improved manner.

In a particularly advantageous embodiment, two transverse rows of such ribs are disposed one behind the other in the direction of travel on the flexible portion of the levelling attachment on the side thereof facing towards the track. In this manner the plate-shaped flexible portion is subdivided into two sections, the leading one of which is brought into effect for levelling snow of medium hardness, while the trailing section is useful for levelling and finishing the surface of soft snow over highly uneven ground. The elongate ribs extending lengthwise in the direction of travel are additionally effective to impart higher flexibility to the plate-shaped portion of the levelling attachment in a direction transverse of the direction of travel, resulting in the levelling attachment adapting itself particularly well to the ground surface.

The transverse carrier member is preferable formed as a box-shaped body having a parallelogram profile in cross-section, the parallelogram side facing towards the track being substantially horizontal while the parallelogram side facing forwards in the direction of travel is inclined rearwards of the direction of travel towards the track for spreading the snow in the transverse direction.

The angle of inclination of the forwards facing parallelogram side may in this case be steeper than that of the forward second triangel side of the rigid portion of the levelling attachment.

The replacement of the levelling attachment is facilitated, and a safe mounting thereof ensured by the provision that the parallelogram side of the box-shaped body facing towards the track is formed with grooves extending transversely of the direction of travel for mounting the levelling attachment, the first triangle side of the rigid portion of the levelling attachment being foremd with projections for mounting the levelling attachment by insertion into the grooves.

The levelling attachment is advantageously a one-piece construction made of a plastic material.

Figure 2:
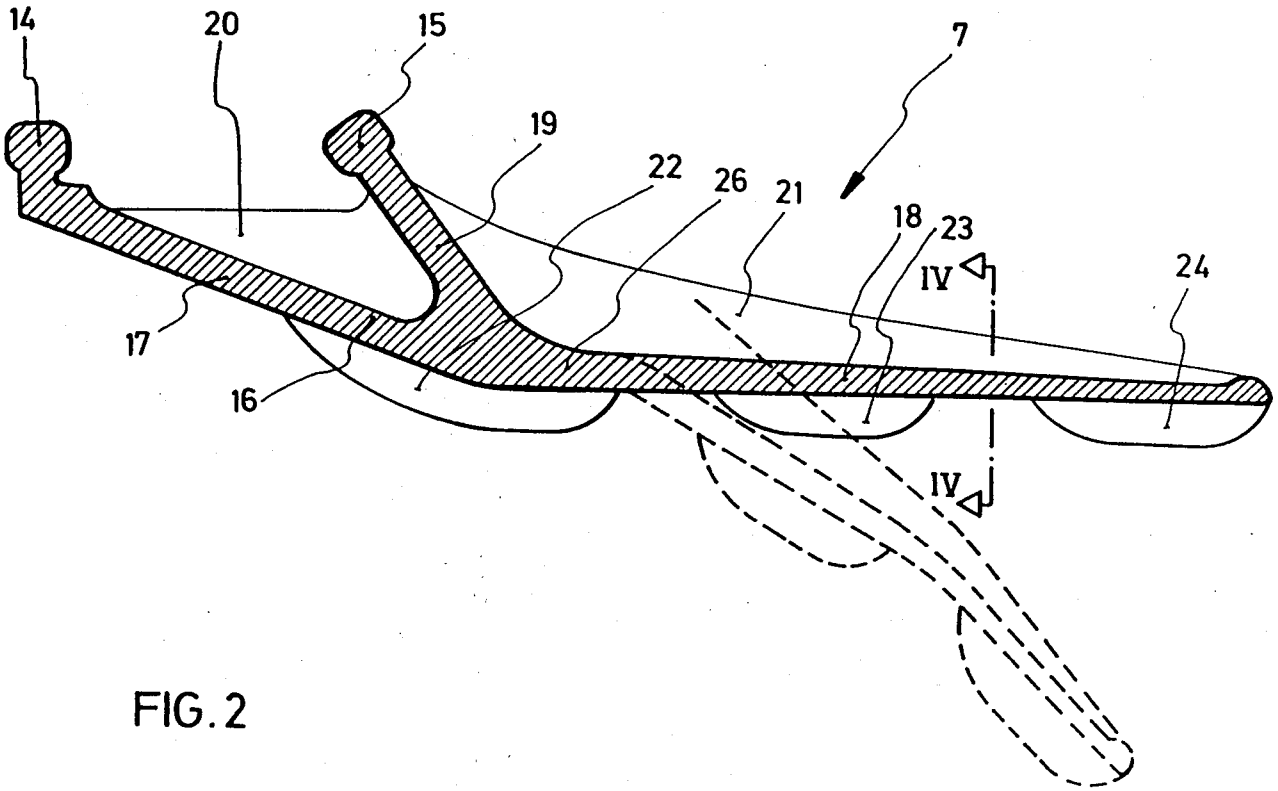
Figure 3:
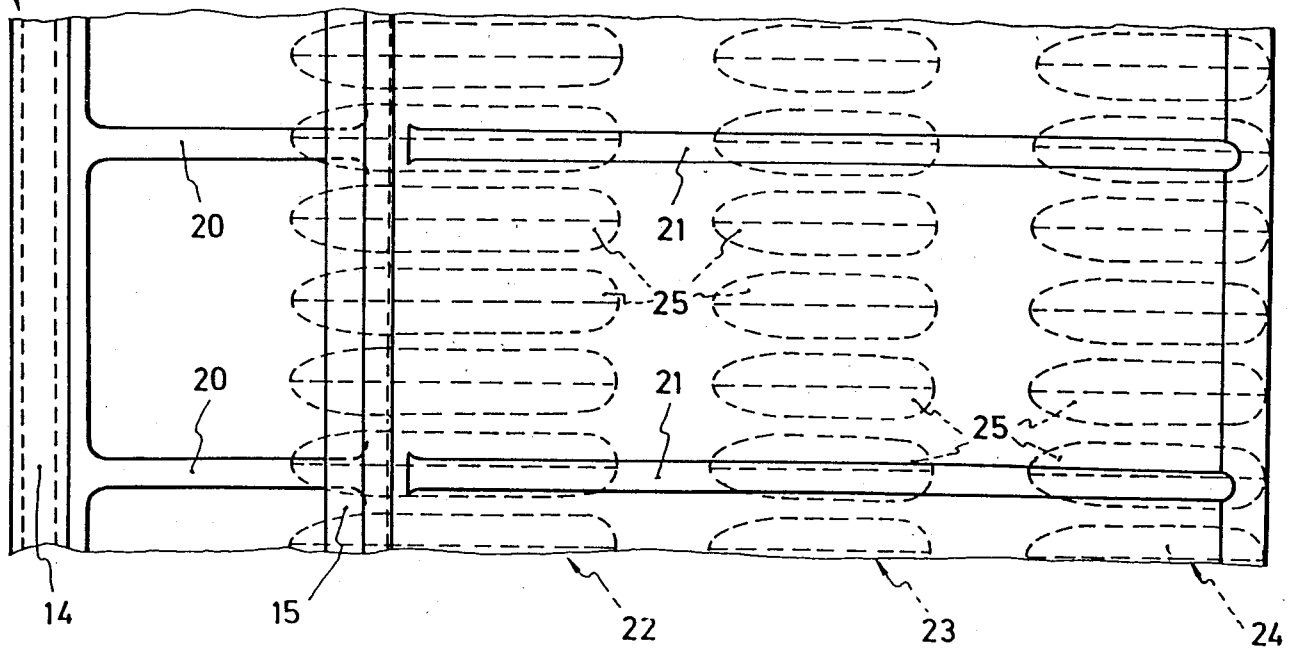
Figure 4:
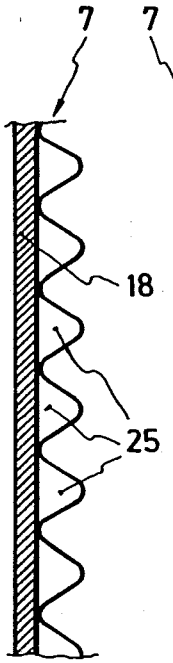

An embodiment of the invention shall now be described in detail by way of example with reference to the accompanying drawings, wherein:

FIG. 1 shows a snow tiller implement mounted for vertical adjustment on the diagrammatically shown rear portion of a track maintenance vehicle and provided with a levelling attachment according to the invention mounted to the rear thereof, FIG. 2 shows an enlarged cross-sectional view of the levelling attachment of FIG. 1, FIG. 3 shows a top plan view of the levelling attachment of FIG. 2, and FIG. 4 shows a sectional view taken along the line IV—IV in FIG. 2.

As particularly shown in FIG. 1, a snow tiller implement 2 is mounted on a rear portion 1 of an otherwise not shown track maintenance vehicle at an adustable height.

Snow tiller implement 2 comprises a frame 3 connected at its rear end to a transverse carrier member 4. Forwards of transverse carrier member 4 in the direction of travel A, the snow tiller 5 proper is secured to frame 3 by a downwards projecting bracket 6 housing the drive mechanism for tiller 5. The lower end of transverse carrier member 4 has a levelling attachment 7 secured thereto.

Transverse carrier member 4 is formed as a box-shaped body having a parallelogram profile in cross-section and extending over the full width of tiller implement 2. The forward parallelogram side 8 facing towards snow tiller 5 is inclined rearwards of the direction of travel A towards the track surface B. Connected to forward parallelogram side 8 by an obtuse angle is a horizontally extending lower parallelogram side 9. Grooves 12 and 13 are formed in transverse carrier member 4 adjacent the leading and trailing edges 10 and 11, respectively, of lower parallelogram side 9. Projections 14 and 15 formed on levelling attachment 7 are inserted into grooves 12 and 13 for mounting levelling attachment 7 on carrier member 4.

Levelling attachment 7 comprises a forward portion 16 of triangular cross-sectional shape. This rigid forward portion 16 is secured to transverse carrier member 4 at its upper triangle face, or rather, by means of the projections 14 and 15 at opposite ends of this triangle side. The leading triangle side 17 facing forwards in the direction of travel A of rigid portion 16 extends downwards and rearwards from the forward parallelogram side 8 of transverse carrier member 4, the angle of inclination of triangle side 17 with respect to the horizontal being smaller than that of forward parallelogram side 8 of carrier member 4. Connected to the trailing and of triangle side 17 is a plate-shaped flexible portion 18. The third triangle side 19 extends from projection 15 to the trailing end of second triangle side 17. Disposed between triangle sides 17 and 19 are vertical stiffener ribs 20 extending parallel to one another in the direction of travel.

Likewise extending parallel to one another in the direction of travel from third triangle side 19 along the top surface of plate-shaped portion 18 to the trailing end thereof are further reinforcing ribs 21. These reinforcing ribs are connected to plate-shaped portion 18, with their vertical height decreasing from third triangle side 19 to the trailing end of plate-shaped portion 18 (cf. FIGS. 2 and 3).

The side of the levelling attachment facing towards the track surface B is provided with three transverse rows 22, 23, 24 of elongate ribs 25 extending lengthwise in the direction of travel A. The ribs 25 of the leading row 22 in the direction of travel A extend from the lower end of second triangle side 17 of rigid portion 16 to the underside of a horizontal rigid web portion 26 provided between rigid portion 16 and flexible portion 18 of levelling attachment 7.

To the rear of first transverse row 22, a second transverse row 23 of bead-shaped ribs 25 is provided on the underside of flexible portion 18 of levelling attachment 7. At a further spaced location to the rear there is provided a third transverse row 24, the ribs 25 of which extend to the trailing end of flexible portion 18. The shape of the individual ribs 25 is particularly evident from the top plan view of FIG. 3 and the sectional view of FIG. 4.

The operation of the levelling attachment according to the invention shall now be explained in detail with reference to the described embodiment. Under no-load conditions, i.e. when snow tiller implement 2 is completely raised above the snow surface, levelling attachment 7 assumes the configuration indicated by dotted lines in FIGS. 1 and 2. In this state, plate-shaped flexible portion 18 extends obliquely downwards substantially parallel to the forward second triangle side 17 of rigid portion 16 of levelling attachment 7. For operating over very soft snow, snow tiller 5 is lowered to a position in which all transverse rows 22, 23 and 24 are in contact with the track surface B. The trailing transverse rows 23 and 24 are resiliently biased into contact with the snow surface, so that they are capable of adapting themselves to the ground contours also in the transverse direction. The rather flexible rearmost transverse row 24 of ribs 25 is thus capable of giving optimum finish to the previously tilled snow even over a strongly contoured ground surface. In front of leading transverse row 22 a distributor space is formed for evenly distributing the tilled snow.

When operating on somewhat harder snow, tiller 5 is lowered to a greater depth in the snow, so that leading transverse row 22 contacts the snow surface with an increased pressure. Under these conditions the resistance offered to the tilled snow may be somewhat increased, while still maintaining a distributor space of sufficient size in front of the levelling transverse row 22. The horizontal rigid web portion 26 has the particularly advantageous effect of forming a snow distribution channel forwards of second transverse row 23. On the other hand, the increased flexibility of the trailing third transverse row 24 of ribs 25 still ensures satisfactory adaptation to the ground contours.

In the case of very hard snow tiller 5 penetrates to a still greater depth, so that the first transverse row 22 of ribs 25 now acts to compact the tilled snow. In this case, the distributor space in front of the rigid portion 16 provided with the first transverse row 22 has become smaller. On the other hand, strongly compacted snow covers are mainly encountered on much-frequented tracks or ski runs on which the snow is already evenly distributed to a large extend, so that the main aspect of the operation is the conditioning of the compacted snow without leaving hard snow lumps projecting above the track surface.

In the embodiment shown, the levelling attachment is of one-piece construction made of polyamide. On the other hand, the levelling attachment is not necessarily of integral construction over the full width of snow tiller implement 2, it being also possible to subdivide the levelling attachment transversely of the direction of travel. The thrid triangle side of the rigid triangular portion may also be replaced by other suitable support elements. The third triangle side may for instance also be made of a compression-resilient material so as to improve the adaptability to the ground contours of the first transverse row 22 when operating on hard snow.

I claim:

1. For use with a maintenance vehicle or the like of the type employed to work the surface of snow on a ski trail, said vehicle having a rearwardly disposed carrier member extending transversely with respect to the direction of vehicle travel, a levelling attachment adapted to be carried by said carrier member and to level the surface of the thus worked snow, said levelling attachment comprising: a forward portion of generally triangular cross-sectional shape having three sides, said forward portion being adapted to be attached to said transverse carrier member along a first of said sides, a second of said sides being formed as a rigid compaction surface extending downwardly and rearwardly from the point of attachment of said forward portion to said transverse carrier member and being connected at its rear end to a plate-shaped flexible portion extending substantially parallel to said second side in the relaxed state, and in a substantially horizontal direction when under load against said snow surface, the third of said sides being formed as a support member extending from the rear end of side second side to said first side.

2. A levelling attachment according to claim 1 further comprising a rigid horizontal web portion formed between the rigid forward portion and said flexible portion.

3. A levelling attachment according to claim 1 further comprising a plurality of reinforcing ribs secured to the surface of said flexible portion facing away from the snow surface and extending parallel to one another in the direction of vehicle travel.

4. A levelling attachment according to claim 3, wherein said reinforcing ribs are connected to the third triangle side of said rigid forward portion.

5. A levelling attachment according to claim 3, wherein the vertical height of said reinforcing ribs decreases towards the rear end of said flexible portion.

6. A levelling attachment according to claim 1 wherein the side thereof adapted to face towards the snow surface is provided with at least one transverse row of elongated bead-shaped ribs extending in the direction of vehicle travel.

7. A levelling attachment according to claim 6, wherein a first transverse row of said ribs is disposed on the underside of said web portion with the ribs thereof extending to locations on the second triangle side of said rigid forward portion.

8. A levelling attachment according to either of claims 6 or 7, wherein a further transverse row of ribs is disposed on said flexible portion at the side thereof adapted to face towards the snow surface.

9. A levelling attachment according to claim 6 wherein two transverse rows of ribs are disposed one behind the other in the direction of vehicle trave on said flexible portion on the side thereof adapted to face towards the snow surface.

* * * * *